US009307788B2

(12) United States Patent
Dube et al.

(10) Patent No.: US 9,307,788 B2
(45) Date of Patent: Apr. 12, 2016

(54) FILTERED CIGARETTE POSSESSING TIPPING MATERIAL

(75) Inventors: Michael Francis Dube, Winston-Salem, NC (US); Paul Stuart Chapman, Winston-Salem, NC (US)

(73) Assignee: R.J. Reynolds Tobacco Company, Winston-Salem, NC (US)

( * ) Notice: Subject to any disclaimer, the term of this patent is extended or adjusted under 35 U.S.C. 154(b) by 1503 days.

(21) Appl. No.: 12/849,487

(22) Filed: Aug. 3, 2010

(65) Prior Publication Data

US 2010/0294289 A1 Nov. 25, 2010

Related U.S. Application Data

(63) Continuation of application No. 11/462,505, filed on Aug. 4, 2006, now Pat. No. 7,789,089.

(51) Int. Cl.

| | |
|---|---|
| ***A24C 5/32*** | (2006.01) |
| ***A24C 5/34*** | (2006.01) |
| ***A24C 5/47*** | (2006.01) |
| ***A24C 5/58*** | (2006.01) |
| ***A24D 1/00*** | (2006.01) |
| ***A24D 1/02*** | (2006.01) |
| ***A24D 3/14*** | (2006.01) |

(52) U.S. Cl.

CPC ..... *A24C 5/471* (2013.01); *A24C 5/586* (2013.01); *A24D 1/00* (2013.01); *A24D 1/02* (2013.01); *A24D 3/14* (2013.01)

(58) Field of Classification Search

None

See application file for complete search history.

(56) References Cited

U.S. PATENT DOCUMENTS

| | | | |
|---|---|---|---|
| 3,308,600 | A | 3/1967 | Erdmann et al. |
| 3,596,663 | A | 8/1971 | Schultz |
| 3,707,975 | A | 1/1973 | Davis |
| 3,972,335 | A | 8/1976 | Tiggelbeck et al. |
| 4,060,091 | A | 11/1977 | Watson et al. |
| 4,077,415 | A | 3/1978 | Preston et al. |

(Continued)

FOREIGN PATENT DOCUMENTS

| | | | |
|---|---|---|---|
| EP | 0 247 702 | A2 | 2/1987 |
| EP | 0 664 089 | A1 | 7/1995 |

(Continued)

OTHER PUBLICATIONS

Borschke, A.J., "Review of Technologies Relating to Menthol Use in Cigarettes", *Rec. Adv. Tob. Sci.*, 1993, pp. 47-70, No. 19.

*Primary Examiner* — Michael H Wilson

*Assistant Examiner* — Phu Nguyen

(74) *Attorney, Agent, or Firm* — Womble Carlyle Sandridge & Rice LLP

(57) ABSTRACT

A filtered cigarette possesses a smokable rod and a filter element. The smokable rod is secured to the filter element using tipping material. The cigarette possesses more than one layer of tipping material. An outer layer of tipping material can overlie at least a portion of an underlying inner layer of tipping material, and during use by the smoker, the outer layer can be removed from the cigarette. Thus, it is possible for a cigarette manufacturer to provide a cigarette that can be used as such by the smoker, or that can be adapted by the smoker to provide a different sensory experience (e.g., the visual, organoleptic, trigeminal, aromatic, and tactile characteristics of the cigarette can be altered by removal of the outer tipping material). Alternatively, the use of the outer layer of tipping material can be used to improve the physical integrity of the cigarette.

26 Claims, 6 Drawing Sheets

(56) References Cited

U.S. PATENT DOCUMENTS

| | | | | |
|---|---|---|---|---|
| 4,082,098 | A | | 4/1978 | Owens, Jr. |
| 4,123,592 | A | | 10/1978 | Ranier et al. |
| 4,236,535 | A | | 12/1980 | Schmidt et al. |
| 4,280,187 | A | | 7/1981 | Reuland et al. |
| 4,281,670 | A | | 8/1981 | Heitmann et al. |
| 4,281,671 | A | | 8/1981 | Bynre et al. |
| 4,340,074 | A | | 7/1982 | Tudor |
| 4,361,156 | A | | 11/1982 | Hall |
| 4,433,696 | A | | 2/1984 | Adams |
| 4,508,525 | A | | 4/1985 | Berger |
| 4,526,183 | A | | 7/1985 | Nichols et al. |
| 4,527,573 | A | | 7/1985 | Hausermann |
| 4,532,943 | A | | 8/1985 | Nichols et al. |
| 4,570,649 | A | | 2/1986 | Nichols et al. |
| 4,600,027 | A | | 7/1986 | Houck et al. |
| 4,601,298 | A | | 7/1986 | Nichols et al. |
| 1,638,818 | A | | 1/1987 | Nichols et al. |
| 4,643,205 | A | | 2/1987 | Redding et al. |
| 4,646,763 | A | | 3/1987 | Nichols |
| 4,649,944 | A | | 3/1987 | Houck, Jr. et al. |
| 4,655,736 | A | | 4/1987 | Keith |
| 4,666,550 | A | | 5/1987 | Spiers et al. |
| 4,677,995 | A | | 7/1987 | Kallianos et al. |
| 4,687,008 | A | | 8/1987 | Houck, Jr. et al. |
| 4,687,009 | A | * | 8/1987 | Nichols ..... 131/336 |
| 4,696,314 | A | | 9/1987 | Kallianos et al. |
| 4,700,725 | A | | 10/1987 | Geiszler, Jr. |
| 4,714,082 | A | | 12/1987 | Banerjee et al. |
| 4,715,390 | A | | 12/1987 | Nichols et al. |
| 4,726,385 | A | | 2/1988 | Chumney, Jr. |
| 4,729,391 | A | | 3/1988 | Woods et al. |
| 4,768,526 | A | | 9/1988 | Pryor |
| 4,807,809 | A | | 2/1989 | Pryor et al. |
| 4,862,905 | A | | 9/1989 | Green, Jr. et al. |
| 4,889,144 | A | | 12/1989 | Tateno |
| 4,941,486 | A | | 7/1990 | Dube et al. |
| 5,012,829 | A | | 5/1991 | Thesing et al. |
| 5,025,814 | A | | 6/1991 | Raker |
| 5,074,321 | A | | 12/1991 | Gentry et al. |
| 5,101,839 | A | | 4/1992 | Jakob et al. |
| 5,141,007 | A | | 8/1992 | Raker et al. |
| 5,159,944 | A | | 11/1992 | Arzonico et al. |
| 5,178,166 | A | | 1/1993 | Newsome et al. |
| 5,211,684 | A | | 5/1993 | Shannon et al. |
| 5,220,930 | A | | 6/1993 | Gentry |
| 5,261,425 | A | | 11/1993 | Raker et al. |
| 5,387,285 | A | | 2/1995 | Rivers |
| 5,396,909 | A | | 3/1995 | Gentry et al. |
| 5,415,189 | A | | 5/1995 | Sampson et al. |
| 5,469,871 | A | | 11/1995 | Barnes et al. |
| 5,819,751 | A | | 10/1998 | Barnes et al. |
| 6,229,115 | B1 | | 5/2001 | Voss et al. |
| 6,537,186 | B1 | | 3/2003 | Veluz |
| 6,568,402 | B1 | | 5/2003 | Kaneki et al. |
| 6,584,979 | B2 | | 7/2003 | Xue et al. |
| 6,595,218 | B1 | | 7/2003 | Koller et al. |
| 6,761,174 | B2 | | 7/2004 | Jupe et al. |
| 7,074,170 | B2 | | 7/2006 | Lanier, Jr. et al. |
| 7,089,944 | B2 | | 8/2006 | Schlisio |
| 7,296,578 | B2 | | 11/2007 | Read, Jr. |
| 7,434,585 | B2 | | 10/2008 | Holmes |
| 2004/0261807 | A1 | | 12/2004 | Dube et al. |
| 2007/0051383 | A1 | | 3/2007 | Woods |
| 2008/0029111 | A1 | | 2/2008 | Dube et al. |

FOREIGN PATENT DOCUMENTS

| | | | |
|---|---|---|---|
| GB | 1 244 110 | | 8/1971 |
| GB | 1 298 142 | | 11/1972 |
| JP | 59-38794 | A | 3/1984 |
| JP | 62-16295 | U | 1/1987 |
| JP | 64-060363 | | 3/1989 |
| JP | 04-293479 | A | 10/1992 |
| JP | 08-322538 | A | 12/1996 |
| WO | WO 00/00047 | A1 | 1/2000 |
| WO | WO 2006/064371 | A1 | 6/2006 |

* cited by examiner

FILTERED CIGARETTE POSSESSING TIPPING MATERIAL

CROSS REFERENCE TO RELATED APPLICATIONS

This application is a continuation of U.S. application Ser. No. 11/462,505, filed Aug. 4, 2006, now U.S. Pat. No. 7,789,089 which is incorporated by reference herein.

FIELD OF THE INVENTION

The present invention relates to smoking articles, such as filtered cigarettes.

BACKGROUND OF THE INVENTION

Popular smoking articles, such as cigarettes, have a substantially cylindrical rod shaped structure and include a charge, roll, or column of smokable material such as shredded tobacco (e.g., in cut filler form) surrounded by a paper wrapper thereby forming a so-called "smokable rod" or "tobacco rod." Normally, a cigarette has a cylindrical filter element aligned in an end-to-end relationship with the tobacco rod. Typically, a filter element comprises cellulose acetate tow plasticized using triacetin, and the tow is circumscribed by a paper material known as "plug wrap." A cigarette can incorporate a filter element having multiple segments, and one of those segments can comprise activated charcoal particles. See, for example, U.S. Pat. No. 6,537,186 to Veluz; PCT Publication No. WO 2006/064371 to Banerjea; and U.S. patent application Ser. No. 11/226,932, filed Sep. 14, 2005, to Coleman III, et al.; each of which is incorporated herein by reference. Typically, the filter element is attached to one end of the tobacco rod using a circumscribing wrapping material known as "tipping paper," in order to provide a so-called "filtered cigarette." It also has become desirable to perforate the tipping material and plug wrap, in order to provide dilution of drawn mainstream smoke with ambient air. Descriptions of cigarettes and the various components thereof are set forth *Tobacco Production, Chemistry and Technology*, Davis et al. (Eds.) (1999). A cigarette is employed by a smoker by lighting one end thereof and burning the tobacco rod. The smoker then receives mainstream smoke into his/her mouth by drawing on the opposite end (e.g., the filter or mouth end) of the cigarette.

Various attempts to alter the visual attributes of cigarettes have been proposed. For example, there have been attempts to alter the color of the wrapping materials that provide the wrapping material of the tobacco rod (e.g., cigarettes marketed under the tradename "More" by R. J. Reynolds Tobacco Company possess cigarette rod wrapping papers exhibiting a brown color) and tipping materials used to attach the tobacco rod to the filter element (e.g., tipping materials have been printed so as to possess a "cork" appearance and/or to possess at least one circumscribing ring). In addition, there have been attempts to alter the general appearance of the filter elements of cigarettes. See, for example, the types of cigarette filter element formats, configurations and designs set forth in U.S. Pat. Nos. 3,596,663 to Schultz; 4,508,525 to Berger; 4,646,763 to Nichols; 4,655,736 to Keith; 4,726,385 to Chummy, Jr.; 4,807,809 to Pryor et al.; and 5,025,814 to Raker; and U.S. patent application Ser. No. 11/377,630, filed Mar. 16, 2006, to Crooks et al.; each of which is incorporated herein by reference.

The sensory attributes of cigarette smoke can be enhanced by applying additives to tobacco and/or by otherwise incorporating flavoring materials into various components of a cigarette. See, Leffingwell et al., *Tobacco Flavoring for Smoking Products*, R. J. Reynolds Tobacco Company (1972). For example, one type of tobacco flavoring additive is menthol. See, Borschke, *Rec. Adv. Tob. Sci.,* 19, p. 47-70, 1993. Various proposed methods for modifying the sensory attributes of cigarettes have involved suggestion that filter elements may be used as vehicles for adding flavor to the mainstream smoke of those cigarettes. U.S. Patent Application Publication No. 2002/0166563 to Jupe et al. proposes the placement of adsorbent and flavor-releasing materials in a cigarette filter. U.S. Patent Application Publication No. 2002/0020420 to Xue et al. proposes the placement of fibers containing small particle size adsorbents/absorbents in the filter. U.S. Pat. Nos. 4,941,486 to Dube et al. and 4,862,905 to Green, Jr. et al. propose manners and methods for the placement of a flavor-containing pellet in each cigarette filter. Other representative types of cigarette filters incorporating flavoring agents are set forth in U.S. Pat. Nos. 3,972,335 to Tiggelbeck et al.; 4,082,098 to Owens, Jr.; 4,281,671 to Byrne; 4,643,205 to Redding et al.; 4,677,995 to Kallianos et al.; 4,715,390 to Nichols et al.; 4,729,391 to Woods et al.; 4,768,526 to Pryor; 5,012,829 to Thesing et al.; 5,387,285 to Rivers; and 7,074,170 to Lanier, Jr. et al.; each of which is incorporated herein by reference. See, also, the types of cigarette filter technologies that are discussed in the background art section set forth in U.S. Patent Application Publication No. 2004/0261807 to Dube et al.; which is incorporated herein by reference.

It would be highly desirable to provide a smoker with the ability to enhance his/her smoking experience, such as can be accomplished by providing a filtered cigarette possessing a filter element end having particular design features. That is, it would be desirable to provide a cigarette possessing filter end components that are employed in a manner such that the visual appearance of the cigarette is aesthetically pleasing. It also would be desirable to provide a cigarette possessing selected design features that can be modified or otherwise controlled. In addition, it would be desirable to provide a filter element for a cigarette that is capable of enhancing the sensory attributes of the cigarette during use.

SUMMARY OF THE INVENTION

The present invention relates to filtered cigarettes. A representative cigarette possesses a smokable rod and a filter element. The smokable rod, which contains filler material (e.g., tobacco cut filler) intended to be burned to yield drawn mainstream tobacco smoke, is connected or otherwise secured to the filter element using tipping material. The cigarette possesses more than one layer of tipping material. For example, the cigarette can possess an outer layer of tipping material that overlies at least a portion of an underlying inner layer of tipping material, and during use by the person desiring to smoke the cigarette, the outer layer can be removed therefrom. Thus, it is possible for a cigarette manufacturer to provide a single cigarette that can be used as such by the smoker, or that can be easily adapted by the smoker to provide a different sensory experience (e.g., the visual, organoleptic, trigeminal, aromatic and tactile characteristics of the cigarette can be altered by removal of the outer tipping material). Alternatively, the use of the outer layer of tipping material can be used as a second layer of tipping material to further improve the physical integrity of the cigarette. In yet another regard, outer tipping material possessing printed indicia (e.g., information printed on the inner surface of a removable outer layer of tipping material) can be used for marketing purposes (e.g., to identify each individual cigarette for purposes of promotional or advertising campaigns, or to identify cigarettes for purposes of discouraging counterfeiting).

Thus, in one embodiment, the invention provides a filtered cigarette comprising a smokable rod and a filter element having a mouth end terminus, the smokable rod and filter element being secured to one another by a first tipping material that circumscribes the filter element along its longitudinal periphery and the smokable rod along a portion of its longitudinal periphery in a region thereof adjacent to the filter element, the cigarette further comprising a second tipping material overlying at least a portion of first tipping material.

The two tipping materials can be substantially identical in overall dimension, or the second tipping material can extends further along the longitudinal periphery of the smokable rod than the first tipping material, or the first tipping material can extend further along the longitudinal periphery of the smokable rod than the second tipping material. Each of the first and second tipping materials can possess a series of air dilution perforations, or only the inner tipping material can include such perforations.

In certain embodiments, all or at least a portion of the second tipping material is removable from the cigarette. In certain applications, the visual appearance, tactile characteristics, or other properties of the two tipping materials can differ such that removal of the second tipping material exposes the smoker to a different property, such as a different flavor or aroma, a different visual appearance, or a different tactile characteristic.

The second tipping material can possess, in certain embodiments, features such as printed indicia on its inner face, a perforated region adapted to facilitate removal of at least a portion of the second tipping material, a tab region adapted for grasping for removal of at least a portion of the second tipping material, or combinations thereof.

There are several ways in which the two tipping materials can be applied to the cigarette rod. For example, the first tipping material and the second tipping material can be formed from a single piece of tipping material wrapped around the filter element. Alternatively, the two tipping materials can be preformed as a tipping material laminate prior to application to the cigarette rod. For example, the tipping material laminate can comprise a first layer of tipping material having a first edge and a second edge and a second layer of tipping material, wherein the first layer and the second layer are offset such that, when wrapped around a rod-shaped object, the first edge of the first layer of tipping material can overlie the second edge of the first layer of tipping material. The first edge of the first layer of tipping material can be coextensive with a first edge of the second layer of tipping material. Alternatively, a first edge of the second layer of tipping material can extend beyond the first edge of the first layer of tipping material, thereby forming a tab region of the second layer of tipping material.

In a further embodiment, the second tipping material comprises a first region proximal to the smokable rod, a second region remote from the smokable rod, and a perforated region therebetween, wherein one of the first and second regions is securely affixed to the first tipping material and the other of the first and second regions is configured to slidably engage the filter element upon perforation of the perforated region. The first region can be configured to slidably engage the filter element and the smokable rod and, for example, can include a flavoring agent adapted to alter the sensory characteristics of the cigarette before, during, or after smoking. In other embodiments, the first region is formed of a non-combustible material and is configured to extinguish the cigarette when slidably engaged with the smokable rod. Alternatively, the second region is configured to slidably engage the filter element and extend beyond the mouth end terminus of the filter element.

In one preferred embodiment, a filtered cigarette is provided comprising a smokable rod and a filter element having a mouth end terminus, the smokable rod and filter element being secured to one another by a first tipping material that circumscribes the filter element along its longitudinal periphery and the smokable rod along a portion of its longitudinal periphery in a region thereof adjacent to the filter element, the cigarette further comprising a second tipping material overlying at least a portion of first tipping material, wherein the second tipping material includes a perforated region and a tab region adapted for grasping such that at least a portion of the second tipping material extending from the tab region to the perforated region is removable from the cigarette.

In another aspect, the invention provides various methods for making the filtered cigarette described above. The methods typically include formation of cigarette rods, such as two-up cigarette rods, including smokable rod portions and filter element portions, in the same manner and using the same techniques known in the art. The methods further include applying at least two layers of tipping material to that cigarette. That is, for example, a filtered cigarette can be tipped using one layer of tipping material, and then tipped again, using a second layer of tipping material. In that regard, the filtered cigarette can be wrapped twice using two separate pieces of tipping material, or the filtered cigarette can be double wrapped using a single piece of tipping material of extended length. Another manner or method for manufacture of a representative filtered cigarette involves applying a layer of multi-layered or laminated tipping material to that cigarette. That is, for example, a filtered cigarette can be tipped a single time using a dual-layered or laminated tipping material so as to provide a cigarette tipped with a two layers of tipping material.

BRIEF DESCRIPTION OF THE DRAWINGS

In order to assist the understanding of embodiments of the invention, reference will now be made to the appended drawings, which are not necessarily drawn to scale and in which like reference numerals refer to like elements. The drawings are exemplary only, and should not be construed as limiting the invention. For the various figures, in order to clearly shown the configurations of the various wrapping materials, the thicknesses of those wrapping materials of the various filtered cigarettes are exaggerated. Most preferably, the wrapping materials are tightly wrapped around the filtered cigarettes to provide a tight or snug fit, to provide a cigarette having acceptable physical integrity, and to provide an aesthetically pleasing appearance.

DETAILED DESCRIPTION OF THE PREFERRED EMBODIMENTS

The present inventions now will be described more fully hereinafter with reference to the accompanying drawing. The invention may be embodied in many different forms and should not be construed as limited to the embodiments set forth herein; rather, these embodiments are provided so that this disclosure will satisfy applicable legal requirements. Like numbers refer to like elements throughout. As used in this specification and the claims, the singular forms "a," "an," and "the" include plural referents unless the context clearly dictates otherwise. Although preferred embodiments of the invention include two layers of tipping material, the invention also encompasses embodiments wherein three or more layers of tipping material are applied to the cigarette.

Figure 1:
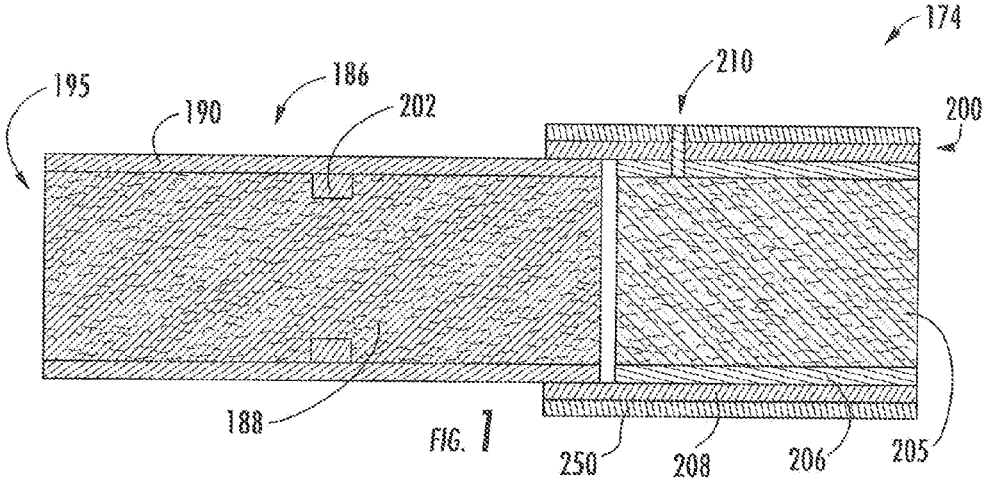
FIG. 1 is a cross-sectional view of one embodiment of a filtered cigarette of the invention.

Referring to FIG. 1, there are shown components of a smoking article 174 in the form of a filtered cigarette. The cigarette 174 includes a generally cylindrical rod 186 of a charge or roll of smokable filler material 188 contained in a circumscribing wrapping material 190 of the present invention. The rod 186 is conventionally referred to as a "smokable rod" or "tobacco rod". The ends of the tobacco rod are open to expose the smokable filler material. At one end of the tobacco rod 186 is the lighting end 195, and at the other end is shown a filter element 200. The cigarette 174 is shown as having one optional printed band 202 printed on wrapping material 190, and that band entirely circumscribes the cigarette rod in a direction transverse to the longitudinal axis of the cigarette. That is, the band provides a cross-directional region relative to the longitudinal axis of the cigarette. The band most preferably is applied to the inner surface of the wrapping material (i.e., facing the smokable filler material), but can be applied to the outer surface of the wrapping material. Although the cigarette shown possesses wrapping material having one band, the cigarette also can possess wrapping material having spaced bands numbering two, three, or more. The band 202 comprises additive materials of a coating formulation.

The cigarette 174 normally includes a filter element 200 or other suitable mouthpiece positioned adjacent one end of the tobacco rod 186 such that the filter element and tobacco rod are axially aligned in an end-to-end relationship, preferably abutting one another. Filter element 200 has a generally cylindrical shape, and the diameter thereof is essentially equal to the diameter of the tobacco rod. The ends of the filter element are open to permit the passage of air and smoke therethrough. The filter element 200 includes filter material 205 (e.g., plasticized cellulose acetate tow) that is overwrapped along the longitudinally extending surface thereof with circumscribing plug wrap material 206. The filter element 200 can comprise two or more filter segments (not shown), and/or flavor additives incorporated therein.

The filter element 200 is attached to the tobacco rod 186 by a first tipping material 208 which circumscribes both the entire length of the filter element and an adjacent region of the tobacco rod. The inner surface of the first tipping material 208 is fixedly secured to the outer surface of the plug wrap 206 and the outer surface of the wrapping material 190 of the tobacco rod, using a suitable adhesive (e.g., a water-based adhesive of the type traditionally employed by cigarette manufacturers for application of tipping paper during filtered cigarette manufacture). That is, the first tipping material extends around the longitudinally extending periphery of substantially the entire length of the plug wrap, and a portion of the longitudinally extending periphery of the wrapping material of the tobacco rod in a region of the tobacco rod immediately adjacent to the filter element. Optionally, a ventilated or air-diluted smoking article is provided with an air dilution means, such as a plurality or series of perforations 210, each of which extend through the tipping material 208 and plug wrap 206. Most preferably, adhesive is applied to a longitudinally extending seam line or lap zone (not shown) of the first tipping material, such as is conventionally employed during cigarette manufacture.

The cigarette 174 also possesses a second tipping material 250. The second tipping material 250 provides an outer layer that overlies and circumscribes the first tipping material 208. All or selected portions of the inner surface of the second tipping material 250 can be fixedly secured to the outer surface of the inner or first tipping material 208. As such, in preferred embodiments, the second tipping material 250 also overlies the entire length of the filter element and the adjacent region of the tobacco rod. For the embodiment shown in FIG. 1, both tipping materials extend essentially equal distances along the region of the tobacco rod that is adjacent the filter element. For certain preferred cigarettes, the first and second tipping materials each are substantially identical in overall dimension (e.g., those tipping materials have comparable thicknesses, widths, and lengths). Optionally, a ventilated or air-diluted smoking article is provided with an air dilution means, such as a series of perforations 210, each of which extends through the outer tipping material 250, the inner tipping material 208, and the plug wrap 206.

Adhesive can be applied in to each of the tipping materials using techniques generally similar to those employed conventionally for tipping material application during cigarette manufacture. In such a manner, the two layers of tipping material can be applied and secured using conventional adhesives and application techniques, and the cigarette so provided is used with both layers of tipping material attached thereto. However, adhesive can be applied to a longitudinally extending seam line or lap zone (not shown) of the second tipping material 250. In such a manner, the second tipping material 250 is adapted and applied to the cigarette such that the second tipping material is purposefully removable from that cigarette. Thus, the resulting filtered cigarette of acceptable quality can be employed by leaving the second tipping material 250 intact; while alternatively, the second tipping material can be removed from the cigarette, with the first tipping material 208 acting to provide for the resulting altered filtered cigarette that also is of acceptable quality.

In one embodiment, the outer or second tipping material 250, which is not treated so as to provide for air dilution to the cigarette, or which is treated in such a manner such that the cigarette does not experience a high degree or level of air dilution, can be removed from the cigarette. As such, the underlying or first tipping material 208, which can be treated so as to provide for a relatively high level of dilution to the cigarette, can be exposed by removal of the overlying second tipping to allow for a higher level of air dilution. As such, the cigarette can be smoked with the second tipping material 250 intact, in order to provide for flavorful mainstream smoke; or that second tipping material can be removed, in order to provide air diluted mainstream smoke that is less flavorful in character.

A representative manner or method for providing such a cigarette involves suitable modification of the equipment and methodologies employed by cigarette manufacturers to provide so-called "banded" cigarettes for consumer research purposes. That is, rather than applying a circumscribing band (e.g., a band of about 1 cm width) around the cigarette in the general region where the tobacco rod and filter element abut one another, a the second tipping material is applied as a circumscribing band over the entire length of the filter element and a portion of the length of the tobacco rod in a region of the tobacco rod adjacent to the filter element. As such, there are provided filtered cigarettes possessing two layers of tipping material that are positioned, applied and aligned in a predetermined, desired fashion, meaning the position and alignment of each layer of tipping material is predetermined by the manufacturer. Such equipment is particularly suitable for applying two appropriately aligned layers tipping material to a cigarette, neither of which layer of tipping material is designed for the purpose of removal from the cigarette (e.g., because adhesive can be applied over substantially the whole inner surface of the outer tipping material). As such, the double-tipped cigarette of the invention can exhibit improved physical integrity. Alternatively, such equipment can be suitable for applying two appropriately aligned layers of tipping material to a cigarette, the outer layer of which is designed for the purpose of removal from the cigarette (e.g., by using a release coating type of adhesive that can be applied over substantially the whole inner surface of the outer tipping material, or over the outer surface of the inner tipping material).

Figure 2:
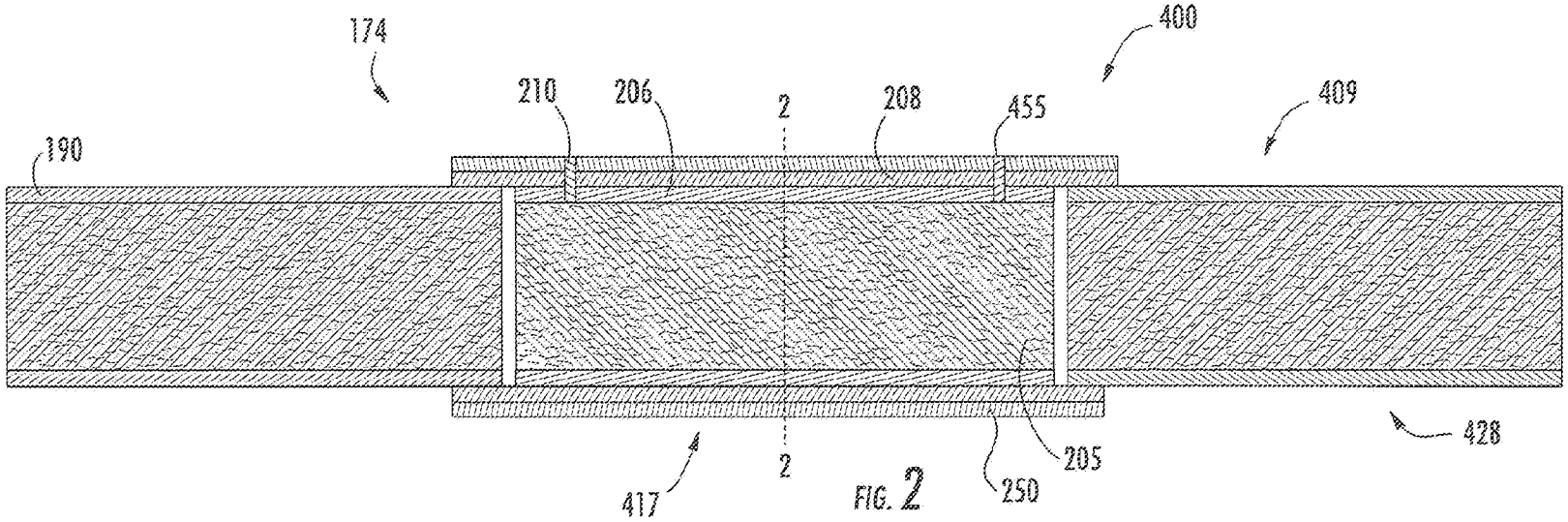
FIG. 2 is a cross-sectional view of one embodiment of a "two-up" filtered cigarette of the invention.

Referring to FIG. 2, there is shown a representative "two-up" cigarette 400 that can be subdivided along hashed line 2-2 in order to provide two filtered cigarettes 174, 409. In addition, representative manners or methods for providing preferred types of cigarettes are described with reference to FIG. 2. A "two-up" filter segment 417 is provided. That representative filter segment 417 possesses filter material 205 circumscribed by plug wrap 206. Two tobacco rods 190, 428 are aligned at each end of the "two-up" filter segment. A first layer of tipping material 208 (e.g., a so-called "patch" of tipping material) is wrapped around the aligned components, such that the tipping material circumscribes the entire length of the "two-up" filter segment 417, and a portion of the length of each tobacco rod 190, 428 in the respective regions thereof adjacent the filter segment. Typically, that first layer of tipping material 208 circumscribes about 3 mm to about 4 mm of the length of each tobacco rod. As such, a so called "two-up" cigarette 400 is provided. For certain preferred embodiments, the first layer of tipping material is selected from a type of tipping material, and is applied in a type of manner, each of which is comparable to that traditionally used for commercial filtered cigarette manufacture. Optionally, that cigarette can be air diluted (e.g., using laser perforation techniques) by applying at least one circumscribing ring of perforations 210, 455 though first layer tipping material 208 and underlying plug wrap 206. Then, the "two-up" cigarette so provided can be transferred to a second tipping assembly. There, a second layer of tipping material 250 (e.g., a second "patch" of tipping material) is wrapped around the "two-up" cigarette 400, such that the second layer of tipping material overlies the first layer of tipping material 208. Optionally, that cigarette can be air diluted (e.g., using laser perforation techniques) by applying at least one circumscribing ring of perforations 210, 455 though the second layer of tipping material 250, first layer tipping material 208 and underlying plug wrap 206. Thus, for the embodiment shown, air dilution perforations can be absent, provided through both layers of tipping materials, or provided through only the first layer of tipping material. Then, the "two-up" combined segment possessing two layers of tipping material is cut in half, perpendicular to its longitudinal axis, to provide two finished cigarettes 174, 409. As such, the two finished cigarettes 174, 409 are both characterized by a smooth mouth end, wherein the mouth end terminus of the filter material 205, plug wrap 206, and tipping materials 208, 250 are all in the same plane. If desired, the two types of "patches" used for tipping materials 208, 250 can be substantially identical to one another (e.g., in terms of overall visual appearance, width, length, thickness, physical properties and/or composition). As such, there are provided filtered cigarettes possessing two layers of tipping material that are positioned, applied and aligned in a pre-determined, desired fashion.

Preparation of a double tipped "two-up" cigarette in the foregoing fashion is particularly suitable for applying two appropriately aligned layers of tipping material to a cigarette, neither of which layer of tipping material is designed for the purpose of being, or intended to be, removed from the cigarette (e.g., because adhesive can be applied over substantially the whole inner surface of the outer tipping material). Alternatively, such a methodology can be suitable for applying two appropriately aligned layers tipping material to a cigarette, the outer layer of which is designed for the purpose of being, or is intended to be, removed from the cigarette (e.g., by using a release coating type of adhesive that can be applied over substantially the whole inner surface of the outer tipping material, or the outer surface of the inner tipping material). If desired, the outer tipping material can be applied so as to possess adhesive on only selected regions thereof, such as can be carried out using so-called "skip gap" types of tipping adhesive application techniques. As such, adhesive can be registered at the desired location on each outer tipping patch, and as such, sufficient adhesive can be applied so as to provide for a longitudinally extending strip to tack to the underlying region of the cigarette (e.g., to the first layer of tipping material) as well as a longitudinally extending strip to tack onto itself (e.g., to allow the folded over outer layer of tipping material to form a type of seam). Optionally, when "skip gap" types of adhesive application are employed, adhesive application can be absent at either or both ends of the adhesive strip on the region of the tipping patch that provides the outer seam of the outer tipping material; and as such, either or both longitudinal end of the outer tipping material can be provided with a type of tab that can be used to grasp the outer tipping material for the purpose of tearing that tipping material away from the remainder of the cigarette. Such tabs typically have widths that are at least comparable to that of the seam line, and lengths of about 2 mm to about 5 mm.

Preparation of a double tipped "two-up" cigarette also can be carried out using a single "patch" of tipping material. In such a manner, a tipping "patch" having an extended length (e.g., at least sufficient in length to allow for that "patch" to be wrapped twice around the relevant region of the "two-up" cigarette) can be employed. For example, the "patch" of tipping material can be wrapped around the "two-up" cigarette to form an inner tipping portion or layer that extends around that "two-up" cigarette, and the "two-up" cigarette can be turned a second time in order that it can be wrapped with the remaining length of the "patch" and hence provide an outer tipping portion or layer. In one embodiment, adhesive can be applied to the entire inner surface of the elongated "patch." In another embodiment, adhesive can be applied to the entire inner surface of the "patch" that forms the inner tipping layer, and "skip gap" techniques can be employed such that only a strip of adhesive (e.g., so as to provide a seam) is applied to the portion of that "patch" that forms the outer tipping layer.

Alternative representative manners or methods for providing certain preferred types of cigarettes also are described with reference to FIG. 2. A "two-up" filter segment 417 possessing filter material 205 circumscribed by plug wrap 206 is provided. Two tobacco rods 190, 428 are aligned at each end of the "two-up" filter segment. A first layer of tipping material 208 and an outer second layer of tipping material 250 are provided as a double layer of tipping material (e.g., as a laminate). That laminated layer of first and second layers of tipping material 208, 250 is wrapped around the aligned components, such that the laminated layer of those two tipping materials circumscribes the entire length of the "two-up" filter segment 417, and a portion of the length of each tobacco rod 190, 428 in the respective regions thereof adjacent the filter segment. As such, the so called "two-up" cigarette 400 is provided. Optionally, that cigarette can be air diluted (e.g., using laser perforation techniques) by applying at least one circumscribing ring of perforations 210, 455 though the second or outer layer of tipping material 250, the first layer or inner layer of tipping material 208, and underlying plug wrap 206. Then, the "two-up" combined segment possessing two layers of tipping material is cut in half perpendicular to its longitudinal axis to provide two finished cigarettes 174, 409. As such, there are provided filtered cigarettes possessing two layers of tipping material that are positioned, applied and aligned in a pre-determined, desired fashion.

Cigarette rods typically are manufactured using a cigarette making machine, such as a conventional automated cigarette rod making machine. Exemplary cigarette rod making machines are of the type commercially available from Molins PLC or Hauni-Werke Korber & Co. KG. For example, cigarette rod making machines of the type known as MkX (commercially available from Molins PLC) or PROTOS (commercially available from Hauni-Werke Korber & Co. KG) can be employed. A description of a PROTOS cigarette making machine is provided in U.S. Pat. No. 4,474,190 to Brand, at col. 5, line 48 through col. 8, line 3, which is incorporated herein by reference. Types of equipment suitable for the manufacture of cigarettes also are set forth in U.S. Pat. Nos. 4,781,203 to La Hue; 4,844,100 to Holznagel; 5,131,416 to Gentry; 5,156,169 to Holmes et al.; 5,191,906 to Myracle, Jr. et al.; 6,647,870 to Blau et al.; 6,848,449 to Kitao et al.; and 6,904,917 to Kitao et al.; and U.S. Patent Application Publication Nos. 2003/0145866 to Hartman; 2004/0129281 to Hancock et al.; 2005/0039764 to Barnes et al.; and 2005/0076929 to Fitzgerald et al.; each of which is incorporated herein by reference.

The components and operation of conventional automated cigarette making machines will be readily apparent to those skilled in the art of cigarette making machinery design and operation. For example, descriptions of the components and operation of several types of chimneys, tobacco filler supply equipment, suction conveyor systems and garniture systems are set forth in U.S. Pat. Nos. 3,288,147 to Molins et al.; 3,915,176 to Heitmann et al.; 4,291,713 to Frank; 4,514,816 to Rudszinat; 4,736,754 to Heitmaim et al. 4,878,506 to Pinck et al.; 5,060,665 to Heitmaim; 5,012,823 to Keritsis et al. and 6,360,751 to Fagg et al.; and U.S. Patent Publication No. 2003/0136419 to Muller; each of which is incorporated herein by reference. The automated cigarette making machines of the type set forth herein provide a formed continuous cigarette rod or smokable rod that can be subdivided into formed smokable rods of desired lengths.

Various types of cigarette components, including tobacco types, tobacco blends, top dressing and casing materials, blend packing densities and types of paper wrapping materials for tobacco rock, can be employed. See, for example, the various representative types of cigarette components, as well as the various cigarette designs, formats, configurations and characteristics, that are set forth in Johnson, Development of Cigarette Components to Meet Industry Needs, 52$^{nd}$ T.S.R.C. (September 1998); U.S. Patent Nos. 5,101,839 to Jakob et al.; 5,159,944 to Arzonico et al.; 5,220,930 to Gentry and 6,779,530 to Kraker; U.S. Patent Publication Nos. 2005/0016556 to Ashcraft et al. and 2005/0066986 to Nestor et al.; and U.S. patent application Ser. Nos. 11/375,700, filed Mar. 14, 2006, to Thomas et al. and 11/408,625, filed Apr. 21, 2006, to Oglesby; each of which is incorporated herein by reference. Most preferably, the entire smokable rod is composed of smokable material (e.g., tobacco cut filler) and a layer of circumscribing outer wrapping material.

Components for filter elements for filtered cigarettes typically are provided from filter rods that are produced using traditional types of rod-forming units, such as those available as KDF-2 and KDF-3E from Hauni-Werke Korber & Co. KG. Typically, filter material, such as filter tow, is provided using a tow processing unit. An exemplary tow processing unit has been commercially available as E-60 supplied by Arjay Equipment Corp., Winston-Salem, N.C. Other exemplary tow processing units have been commercially available as AF-2, AF-3, and AF-4 from Hauni-Werke Korber & Co. KG. In addition, representative manners and methods for operating a filter material supply units and filter-making units are set forth in U.S. Pat. Nos. 4,281,671 to Byrne; 4,862,905 to Green, Jr. et al.; 5,060,664 to Siems et al.; 5,387,285 to Rivers; and 7,074,170 to Lanier, Jr. et al. Other types of technologies for supplying filter materials to a filter rod-forming unit are set forth in U.S. Pat. Nos. 4,807,809 to Pryor et al. and 5,025,814 to Raker; which are incorporated herein by reference.

The filter material can vary, and can be any material of the type that can be employed for providing a tobacco smoke filter for cigarettes. Preferably a traditional cigarette filter material is used, such as cellulose acetate tow, gathered cellulose acetate web, polypropylene tow, gathered cellulose acetate web, gathered paper, strands of reconstituted tobacco, or the like. Especially preferred is filamentary tow such as cellulose acetate, polyolefins such as polypropylene, or the like. One filter material that can provide a suitable filter rod is cellulose acetate tow having 3 denier per filament and 40,000 total denier. As another example, cellulose acetate tow having 3 denier per filament and 35,000 total denier can provide a suitable filter rod. As another example, cellulose acetate tow having 8 denier per filament and 40,000 total denier can provide a suitable filter rod. For further examples, see the types of filter materials set forth in U.S. Pat. Nos. 3,424,172 to Neurath; 4,811,745 to Cohen et al.; 4,925,602 to Hill et al.; 5,225,277 to Takegawa et al. and 5,271,419 to Arzonico et al.; each of which is incorporated herein by reference.

Normally a plasticizer such as triacetin is applied to the filamentary tow in traditional amounts using known techniques. Other suitable materials or additives used in connection with the construction of the filter element will be readily apparent to those skilled in the art of cigarette filter design and manufacture. See, for example, U.S. Pat. No. 5,387,285 to Rivers.

The plug wrap can vary. See, for example, U.S. Pat. No. 4,174,719 to Martin. Typically, the plug wrap is a porous or non-porous paper material. Suitable plug wrap materials are commercially available. Exemplary plug wrap papers ranging in porosity from about 1,100 CORESTA units to about 26,000 CORESTA units are available from Schweitzer-Maudit International as Porowrap 17-M1, 33-M1, 45-M1, 70-M9, 95-M9, 150-M4, 150-M9, 240M9S, 260-M4 and 260-M4T; and from Miquel-y-Costas as 22HP90 and 22HP150. Non-porous plug wrap materials typically exhibit porosities of less than about 40 CORESTA units, and often less than about 20 CORESTA units. Exemplary non-porous plug wrap papers are available from Olsany Facility (OP Paprina) of the Czech Republic as PW646; Wattenspapier of Austria as FY/33060; Miquel-y-Costas of Spain as 646; and Schweitzer-Mauduit International as MR650 and 180. Plug wrap paper can be coated, particularly on the surface that faces the filter material, with a layer of a film-forming material. Such a coating can be provided using a suitable polymeric film-forming agent (e.g., ethylcellulose, ethylcellulose mixed with calcium carbonate, nitrocellulose, nitrocellulose mixed with calcium carbonate, or a so-called lip release coating composition of the type commonly employed for cigarette manufacture). Alternatively, a plastic film (e.g., a polypropylene film) can be used as a plug wrap material. For example, non-porous polypropylene materials that are available as ZNA-20 and ZNA-25 from Treofan Germany GmbH & Co. KG can be employed as plug wrap materials.

Cigarette filter rods can be used to provide multi-segment filter rods. Such multi-segment filter rods then can be employed for the production of filtered cigarettes possessing multi-segment filter elements. An example of a two-segment filter element is a filter element possessing a first cylindrical segment incorporating activated charcoal particles dispersed within cellulose acetate tow (e.g., a "dalmation" type of filter segment) at one end, and a second cylindrical segment that is produced from a filter rod produced essentially of flavored, plasticized cellulose acetate tow filter material at the other end. The production of multi-segment filter rods can be carried out using the types of rod-forming units that traditionally have been employed to provide multi-segment cigarette filter components. Multi-segment cigarette filter rods can be manufactured using a cigarette filter rod making device available under the brand name Mulfi from Hauni-Werke Korber & Co. KG of Hamburg, Germany. Representative types of filter designs and components, including representative types of segmented cigarette filters, are set forth in U.S. Pat. Nos. 4,920,990 to Lawrence et al.; 5,012,829 to Thesing et al.; 5,025,814 to Raker; 5,074,320 to Jones et al.; 5,105,838 to White et al.; 5,271,419 to Arzonico et al.; 5,360,023 to Blakley et al.; 5,396,909 to Gentry et al.; and 5,718,250 to Banerjee et al; U.S. Patent Application Publication Nos. 2002/0166563 to Jupe et al., 2004/0261807 to Dube et al. and 2005/0066981 to Crooks et al.; PCT Publication No. WO 03/009711 to Kim; PCT Publication No. WO 03/047836 to Xue et al.; and U.S. patent application Ser. No. 11/226,932, filed Sep. 14, 2005, to Coleman III, et al.; which are incorporated herein by reference.

The length of the filter element of each cigarette can vary. Typically, the overall length of a filter element is about 20 mm to about 40 mm, and often about 25 mm to about 35 mm. For a typical dual-segment filter element, the downstream or mouth end filter segment often has a length of about 10 mm to about 20 mm; and the upstream or tobacco rod end filter segment often has a length of about 10 mm to about 20 mm.

Filter elements, or filter segment components of combination filters, typically are provided from filter rods that are manufactured using traditional types of cigarette filter rod making techniques. For example, so-called "six-up" filter rods, "four-up" filter rods and "two-up" filter rods that are of the general format and configuration conventionally used for the manufacture of filtered cigarettes can be handled using conventional-type or suitably modified cigarette rod handling devices, such as tipping devices available as Lab MAX, MAX, MAX S or MAX 80 from Hauni-Werke Korber & Co. KG. See, for example, the types of devices set forth in U.S. Pat. Nos. 3,308,600 to Erdmann et al.; 4,281,670 to Heitmann et al.; 4,280,187 to Reuland et al.; 4,850,301 to Greene, Jr. et al.; and 6,229,115 to Vos et al.; and U.S. Patent Application Publication Nos. 2005/0103355 to Holmes, 2005/1094014 to Read, Jr., and 2006/0169295 to Draghetti, each of which is incorporated herein by reference. The operation of those types of devices will be readily apparent to those skilled in the art of automated cigarette manufacture. Manners and methods for applying adhesives to tipping materials during automated cigarette manufacture will be apparent to those skilled in the art of cigarette design and manufacture. For example, a filtered cigarette can be tipped with a first layer of tipping material in an essentially traditional manner using a Lab MAX tipping device that is available from Hauni-Werke Korber & Co. KG, and that tipped cigarette can be collected and tipped again using that device (e.g., using the device in an essentially traditional manner, or in a suitably modified manner to provide a desired pattern of adhesive application) in order to provide a filtered cigarette possessing two layers of tipping material.

The first layer of tipping material most preferably extends over the entire length of the filter element, and about 2 mm to about 6 mm, often about 3 mm to about 5 mm, and frequently about 4 mm over the length of the adjacent region of the tobacco rod. The second layer of tipping material most preferably extends over the entire length of the filter element, and about 2 mm to about 6 mm, often about 3 mm to about 5 mm, and frequently about 4 mm over the length of the adjacent region of the tobacco rod.

The tipping material that is used for any of the tipping material layers can vary. In certain preferred embodiments, the material used to construct both tipping material layers has the characteristics and qualities commonly associated with cigarette tipping materials known in the art. As such, both layers can be constructed of the types of material conventionally used as tipping material in the manufacture of cigarettes. Typical tipping materials are papers exhibiting relatively high opacities. Representative tipping materials have TAPPI opacities of greater than about 81 percent, often in the range of about 84 percent to about 90 percent, and sometimes greater than about 90 percent. Typical tipping materials are printed with inks, typically nitrocellulose based, which can provide for a wide variety of appearances and "lip release" properties. Representative tipping papers materials have basis weights ranging from about 25 $m/m^2$ to about 60 $g/m^2$, often about 30 $g/m^2$ to about 40 $g/m^2$. Representative tipping papers are available as Tervakoski Reference Nos. 3121, 3124, TK 652, TK674, TK675, A360 and A362; and Schweitzer-Mauduit International Reference Nos. GSR270 and GSR265M2. See also, for example, the types of tipping materials, the methods for combining cigarette components using tipping materials, and techniques for wrapping various portions of cigarettes using tipping materials, that are set forth in U.S. patent application Ser. No. 11/377,630, filed Mar. 16, 2006, to Crooks et al.

Adhesives used to secure tipping materials to each other or to other filtered cigarette components can vary. Typical exemplary adhesive formulations that are used for application of tipping material to other cigarette components in commercial filtered cigarette manufacturing operations are water-based emulsions incorporating mixtures of ethylene vinyl acetate copolymers and polyvinylacetate. Representative adhesives that are useful for applying tipping materials to cigarette components are available as Reference Nos. 32-2049 and 32-2124 from National Starch & Adhesives Corp. See also, for example, Skeist, Handbook of Adhesives, 2" Edition (1977); Schneberger, Adhesive in Manufacturing (1983); Gutcho, Adhesives Technology Developments Since 1979

(1983); Landrock, Adhesives Technology Handbook (1985); and Flick, Handbook of Adhesives Raw Materials, 2" Edition (1989).

Pressure-sensitive adhesives can be used to provide for adhesion of the outer tipping material to the remaining components of the cigarette (e.g., particularly for manufacture, handling, packaging, shipping, storage and initial use of the cigarette), as well as for providing the ability to readily release (e.g., particularly so that the outer tipping can be readily removed from the cigarette when desired). That is, suitable preferred pressure-sensitive adhesives provide a satisfactory but temporary bond between the outer tipping material and the remaining components of the cigarette, and that adhesive is such that the outer tipping material or a portion thereof can be peeled away, and hence removed from the cigarette, most preferably without leaving to any significant or readily noticeable degree, any adhesive residue on the underlying cigarette components. In addition, suitable preferred pressure-sensitive adhesives, though providing sufficient adhesion so that a double tipped cigarette can be used as desired without adhesive failure (i.e., so as to avoid undesirable premature release of portions of the outer tipping from the cigarette), is most preferably such that purposeful removal of the outer tipping material does not cause any significant or noticeable structural failure to the underlying cigarette components. That is, most preferably, after purposeful removal of the outer tipping material, the resulting cigarette does not possess any significant visual or structural damage resulting from the presence and removal of that outer tipping material. If desired, the outer surface of the underlying first tipping material optionally can be coated with a lacquer, or other suitable coating material, in order to provide a propensity for substantially all the pressure-sensitive adhesive to be removed along with the outer tipping material. Representative pressure-sensitive adhesives are commercially available from a wide variety of sources, such as 3M, Rohm & Haas Company, and Ashland Specialty Chemical Company. See, also, for example, Satas, Handbook of Pressure-Sensitive Adhesive Technology (1982), and Satas, Advances in Pressure Sensitive Adhesive Technology 2 (1995).

Cigarettes can be air diluted. Tipping materials can be pre-perforated, or air diluted on-line using laser perforation techniques. For cigarettes that are air diluted or ventilated, the amount or degree of air dilution or ventilation can vary. Frequently, the amount of air dilution for an air diluted cigarette is greater than about 10 percent, generally is greater than about 20 percent, often is greater than about 30 percent, and sometimes is greater than about 40 percent. Typically, the upper level for air dilution for an air diluted cigarette is less than about 80 percent, and often is less than about 70 percent. As used herein, the term "air dilution" is the ratio (expressed as a percentage) of the volume of air drawn through the air dilution means to the total volume and air and smoke drawn through the cigarette and exiting the extreme mouth end portion of the cigarette. For certain preferred air diluted cigarettes, the cigarettes are air diluted in such a manner that the cigarette exhibits substantially identical levels of air dilution when the second layer is present on the cigarette and when the second layer is removed from the cigarette (e.g., by laser perforating relevant regions of a "two-up" cigarette after that cigarette has the second layer of tipping material applied thereto).

Figure 3:
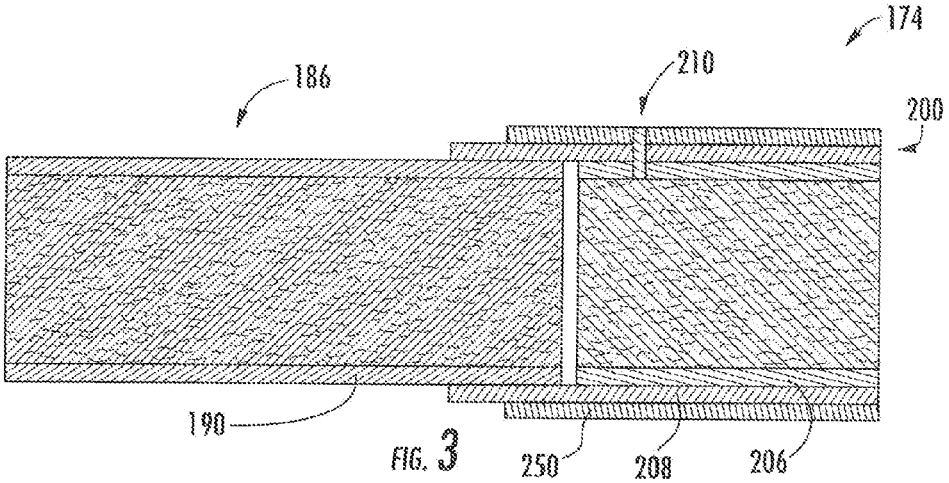
FIGS. 3 through 5 are cross-sectional views of further selected embodiments of filtered cigarettes of the invention.

Referring to FIG. 3, there is shown a further embodiment of a filtered cigarette 174. A first tipping material 208 circumscribes both the entire length of the filter element and an adjacent region of the tobacco rod. The inner surface of the first tipping material 208 is fixedly secured to the outer surface of the plug wrap 206 and the outer surface of the wrapping material 190 of the tobacco rod, using a suitable adhesive. Optionally, a ventilated or air-diluted smoking article is provided with an air dilution means, such as a series of perforations 210, each of which extend through the first tipping material 208 and plug wrap 206. The cigarette 174 also possesses a second tipping material 250. The second tipping material 250 provides an outer layer that overlies and circumscribes the first tipping material 208. The second tipping material 250 does not extend as far upstream along the cigarette as does the first tipping material 208, and as such, a portion of the length of the first tipping material is not covered or overwrapped by the second tipping material 250. The inner surface, or some portion thereof, of the second tipping material 250 can be fixedly secured to the outer surface of the inner or first tipping material 208. As such, the second tipping material 250 also can overlie the entire length of the filter element and the adjacent region of the tobacco rod. Optionally, a ventilated or air-diluted smoking article is provided with an air dilution means, such as a series of perforations 210, each of which extends through the outer tipping material 250, the inner tipping material 208, and the plug wrap 206.

Figure 4:
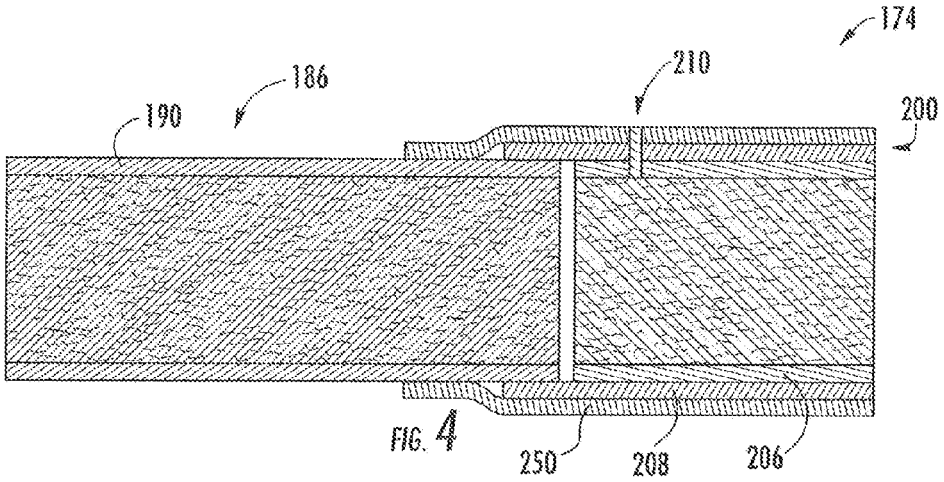

Referring to FIG. 4, there is shown another embodiment of a filtered cigarette 174. A first tipping material 208 circumscribes both the entire length of the filter element and an adjacent region of the tobacco rod. The inner surface of the first tipping material 208 is fixedly secured to the outer surface of the plug wrap 206 and the outer surface of the wrapping material 190 of the tobacco rod, using a suitable adhesive. Optionally, a ventilated or air-diluted smoking article is provided with an air dilution means, such as a series of perforations 210, each of which extend through the first tipping material 208 and plug wrap 206. The cigarette 174 also possesses a second tipping material 250. The second tipping material 250 provides an outer layer that overlies and circumscribes the first tipping material 208. The second tipping material 250 extends further upstream along the cigarette as does the first tipping material 208, and as such, a portion of the length of the wrapping material 190 of the tobacco rod that is not covered or overwrapped by the first tipping material is circumscribed by the second tipping material 250. The inner surface, or some portion thereof, of the second tipping material 250 can be fixedly secured to the outer surface of the inner or first tipping material 208, and optionally though preferably, the wrapping material 190 in that upstream region thereof that is not circumscribed by the first tipping material. As such, the second tipping material 250 also can overlie the entire length of the filter element and the adjacent region of the tobacco rod. Optionally, a ventilated or air-diluted smoking article is provided with an air dilution means, such as a series of perforations 210, each of which extends through the outer tipping material 250, the inner tipping material 208, and the plug wrap 206.

Figure 5:
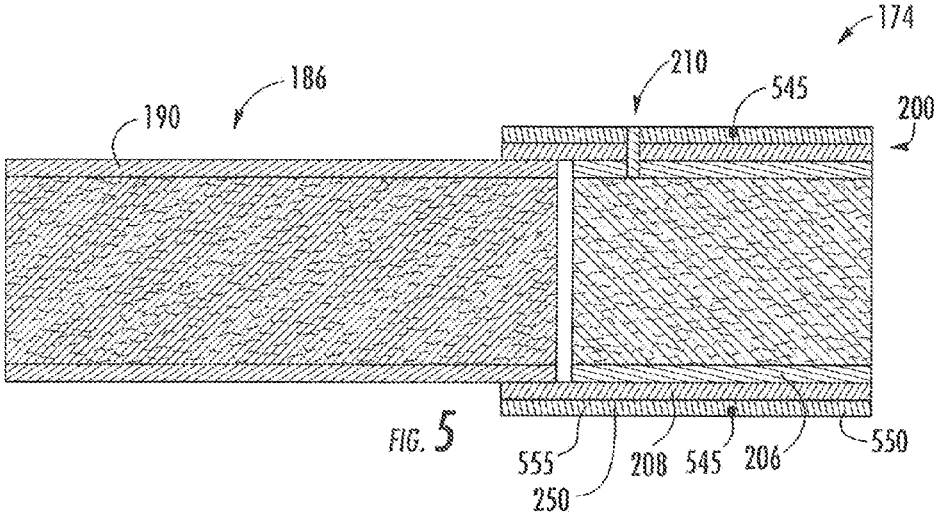

Referring to FIG. 5, there is shown yet another embodiment of a filtered cigarette 174. A first tipping material 208 circumscribes both the entire length of the filter element 200 and an adjacent region of the tobacco rod 186. The inner surface of the first tipping material 208 is fixedly secured to the outer surface of the plug wrap 206 and the outer surface of the wrapping material 190 of the tobacco rod, using a suitable adhesive. Optionally, a ventilated or air-diluted smoking article is provided with an air dilution means, such as a series of perforations 210, each of which extend through the first tipping material 208 and plug wrap 206. The cigarette 174 also possesses a second tipping material 250. The second tipping material 250 provides an outer layer that overlies and circumscribes the first tipping material 208. Optionally, a ventilated or air-diluted smoking article is provided with an air dilution means, such as a series of perforations 210, each of which extends through the outer tipping material 250, the inner tipping material 208, and the plug wrap 206. The second tipping material 250 possesses a line or ring of a plurality of perforations 545 that extends around the cigarette essentially perpendicular to the longitudinal axis of that cigarette. As such, the second tipping material 250 can be subdivided about the line of perforations in order to provide two pieces of outer tipping material, one outer piece or segment 550 located at the extreme mouth end of the cigarette, and the other outer piece 555 located upstream from that mouth end segment.

In one embodiment, the outer mouth end piece or segment 550 of second tipping material 250 is secured to the corresponding underlying region of the first tipping material 208. Preferably, the upstream segment is formed into the general shape of a ring or tube (e.g., by applying sufficient adhesive to the seam line thereof, but not sufficient adhesive to cause prevention of longitudinal movement of that ring or tube). As such, When the region possessing perforations 545 is broken, the upstream segment 555 of second tipping material can be movable along the tobacco rod 186. As such, the upstream segment 555 can act as a cuff, ring, slidable band, or the like. Such a slidable band can be used to provide flavor to a desired region of the tobacco rod (e.g., the inner face of the band can possess a film incorporating a plurality of microcapsules comprising micro-encapsulated flavoring agent, or a flavoring agent that is otherwise entrapped by a film-like or encapsulating agent, and friction resulting from movement of the band along the smokable rod can result in the release of contained flavoring agent and the application of that flavoring agent to the wrapping material of the tobacco rod), act as a movable non-combustible band to extinguish the cigarette during use (e.g., a band composed of a highly non-air permeable material, heat sinking material, or a material treated so as to be essentially non-combustible that can be positioned over a desired region of the tobacco rod), or act as a visual check to view progress of smoking (e.g., the band can be positioned over a desired location of the tobacco rod prior to commencement of the smoking experience), or can serve any other suitable purpose. Thus, the movable or slidable portion of the outer tipping material can be moved or slid by the smoker before, during, or after smoking of the cigarette as desired. In some embodiments, the movable portion of the outer tipping material can be adapted to improve the sensory characteristics of the cigarette butt following smoking by providing, for example, a pleasing scent or otherwise masking any odor associated with the cigarette butt. In one exemplary embodiment, the outer tipping material includes micro-encapsulated flavoring agents that can be selectively ruptured by the user after smoking to improve odor associated with the cigarette butt. In another exemplary embodiment, the movable portion can be used to snuff out or extinguish the cigarette by moving all or a portion of the outer tipping material over the lit end of the cigarette, optionally with additional pressure applied by the user to the outer surface of the movable portion of the tipping material once it is positioned over the burning portion of the tobacco rod.

In one embodiment, the outer upstream piece or segment 555 of second tipping material 250 is secured to the corresponding underlying region of the first tipping material 208. Preferably, the downstream segment is formed into the general shape of a ring or tube (e.g., by applying sufficient adhesive to the seam line thereof, but not sufficient adhesive to cause prevention of longitudinal movement of that ring or tube). As such, when the region possessing perforations 545 is broken, the mouth end segment 550 of second tipping material can be movable along the filter element. As such, the mouth end segment 550 can act as a type of extension to lengthen the mouth end region of the cigarette. For example, that segment can slide out the filter end of the cigarette and as such fashion a type of cigarette holder to lengthen the rod.

Figure 6:
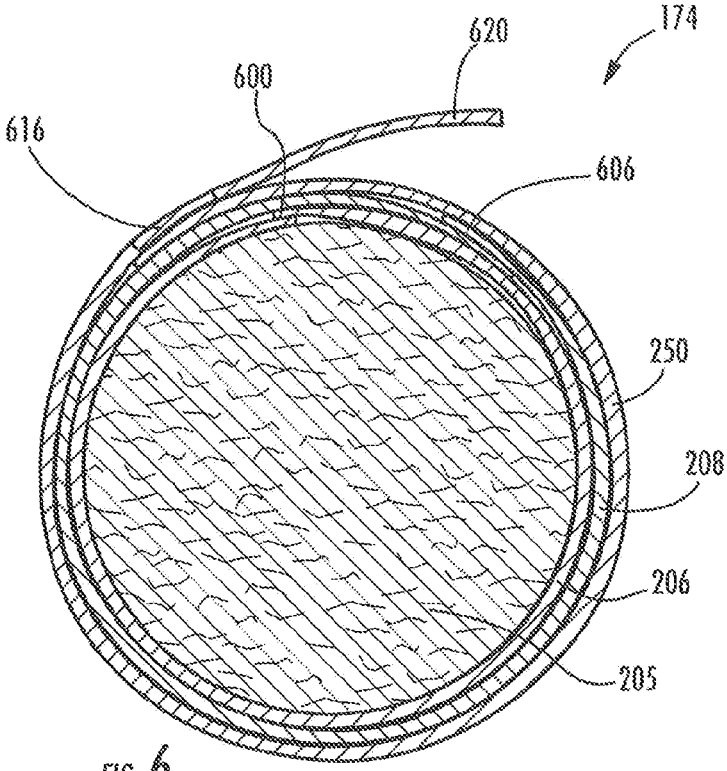
FIGS. 6 and 7 are end views, viewed from the mouth end, of selected embodiments of filtered cigarettes of the invention.

Referring to FIG. 6, there is shown the mouth end region of a filtered cigarette 174, such as a filter cigarette of the type described previously with reference to FIGS. 1 and 3 through 5. The filter material 205 is circumscribed by plug wrap 206, which possesses a lap or seam region 600 where a portion of the plug wrap overlies itself. The lap zone for the plug wrap typically is about 2 mm to about 4 mm in width. Overlying the plug wrap 206 is a layer of first tipping material 208, which possesses a lap or seam region 606 where a portion of that tipping material overlies itself. The lap zone for the first tipping material typically is less than about 4 mm, often less than about 3 mm, and is frequently about 1.5 mm to about 2.5 mm in width. Overlying the first tipping material 208 is a layer of second tipping material 250, which possesses a lap or seam region 616 where a portion of that tipping material overlies itself. The lap zone for the second tipping material typically is less than about 4 mm, often less than about 3 mm, and is frequently about 1.5 mm to about 2.5 mm in width. In addition, beyond the seam region 616 of the second tipping material 250, that tipping material possesses an optional extended region 620, which preferably is not adhered back onto itself, but rather, lies over its underlying outer surface and is sufficiently free to act as a tab that can be grasped by the fingers of the user. The extended region, which preferably extends along a portion of the length of the cigarette, and for the entire length of the second tipping material, has a width that can vary. For example, the extended region often can have a width of about 1 mm to about 5 mm, and often about 2 mm to about 4 mm. If desired, printed indicia on the outer surface of the second tipping material can provide indication of the location of the extended region.

Figure 7:
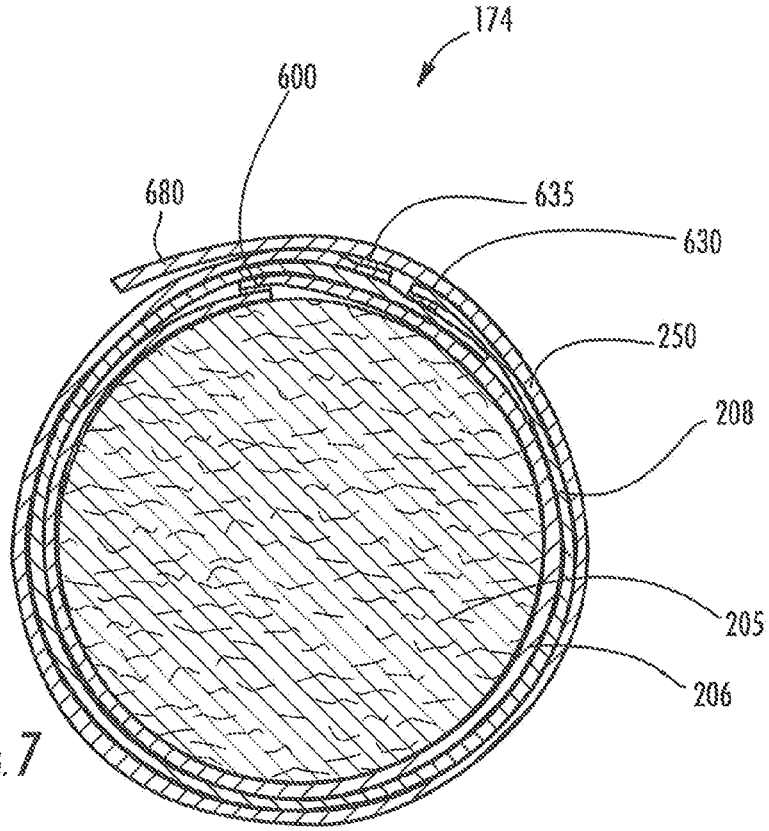

Referring to FIG. 7, there is shown the mouth end region of a filtered cigarette 174, such as a filter cigarette of the type described previously with reference to FIGS. 1 and 3 through 5. The filter material 205 is circumscribed by plug wrap 206, which possesses a lap or seam region 600 where a portion of the plug wrap overlies itself. Overlying the plug wrap 206 is a double layer, and most preferably, a laminated layer, of first and second tipping materials 208, 250. The double layer of tipping materials possesses a lap or seam region 630 where a portion of the bottom or inner face of the first tipping material 208 overlies a portion of the its upper or outer face. That lap zone for the first tipping material typically is less than about 4 mm, often less than about 3 mm, and is frequently about 1.5 mm to about 2.5 mm in width. The double layer of tipping materials can possess an optional, though not preferable, lap or seam region 635 where a portion of the bottom or inner face of the second tipping material 250 overlies a portion of the its upper or outer face, and wherein the lap or seam region includes an optional adhesive for securing the second tipping material to itself. That optional lap zone for the second tipping material, when present, typically is less than about 4 mm, often less than about 3 mm, and is frequently about 1.5 mm to about 2.5 mm in width. In addition, beyond the seam region 635, the second or outer tipping Material 250 possesses an extended region 680, which preferably does not have adhesive applied to its inner face, but rather, lies over its underlying outer surface and is sufficiently free to act as a tab that can be grasped by the fingers of the user. The extended region, which preferably extends along a portion of the length of the cigarette, and for the entire length of the second tipping material, has a width that can vary. For example, the extended region often can have a width of about 1 mm to about 5 mm, and often about 2 mm to about 4 mm. If desired, printed indicia on the outer surface of the second tipping material can provide indication of the location of the extended region.

Figure 8:
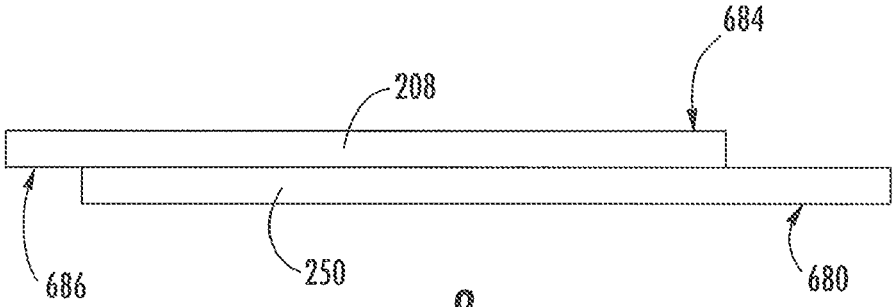
FIGS. 8 and 9 are side views of selected embodiments of laminated tipping materials that are useful for the manufacture of cigarettes of the invention.

Referring to FIG. 8, there is shown a side view of a representative laminated tipping material possessing layers provided by a first tipping material 208 and a second tipping material 250. The configuration of those tipping materials 208, 250 is such that the laminated layer of tipping material can be used to provide a filtered cigarette of the type described previously with reference to FIG. 7. The layers of tipping material 208, 250 are offset relative to one another, such that a portion of the second layer 250 does not overlie the first layer 208 at one side, and a portion of the first layer 208 does not overlie the second layer 250 at the opposite side. As such, the laminate can be folded over itself so as to provide a generally circular arrangement with the first layer of tipping material forming the inner region and the second layer of tipping material forming the outer tipping region. For the embodiment shown, the inside right face 684 of the inner tipping material 208 can overlap and be adhered to outside left face 686 of the left side of the inner tipping material in that region that is not overlapped by the outer tipping material 250. As such, right side 680 of the outer tipping material 250 can act as the so-called extended region or tab that can be used to pull the removable tipping material away from the rest of the filtered cigarette within which it is incorporated.

Figure 9:
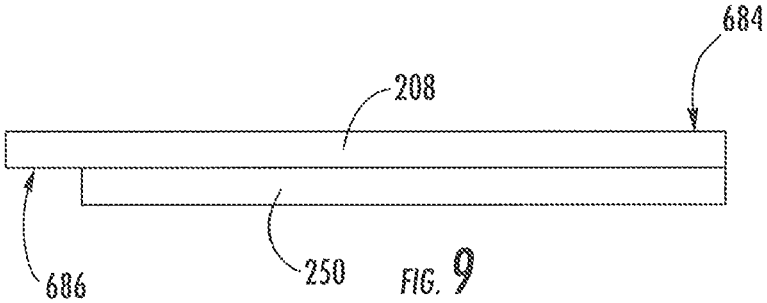

Referring to FIG. 9, there is shown a side view of a further embodiment of a laminated tipping material possessing layers provided by a first tipping material 208 and a second tipping material 250. The configuration of those tipping materials 208, 250 is such that the laminated layer of tipping material can be used to provide a filtered cigarette generally of the type described previously with reference to FIG. 7. The layers of tipping material 208, 250 are offset relative to one another, such that a portion of the second layer 250 does not overlie the first layer 208 at one side 686. For the embodiment shown, the inside right face 684 of the inner tipping material 208 can overlap and be adhered to outside left face 686 of the left side of the inner tipping material in that region that is not overlapped by the outer tipping material 250. As such, the laminate can be folded over itself so as to provide a generally circular arrangement with the inner tipping material forming the inner region and the outer tipping material forming the outer tipping region.

Figure 10:
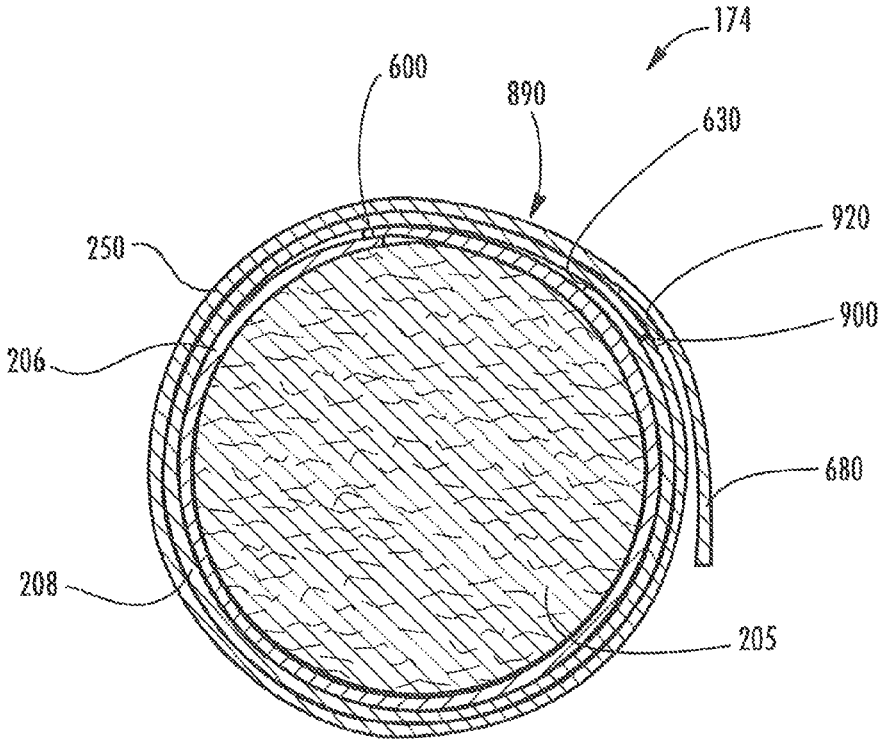
FIG. 10 is an end view, viewed from the mouth end, of one embodiment of a filtered cigarette of the invention.

Referring to FIG. 10, there is shown the mouth end region of a filtered cigarette 174, such as a filter cigarette of the type described previously with reference to FIGS. 1 and 3 through 5. The filter material 205 is circumscribed by plug wrap 206, which possesses a lap or seam region 600 where a portion of the plug wrap overlies itself. Overlying the plug wrap 206 is a double layer of first and second tipping materials 208, 250 that are provided encircling the cigarette twice with a single piece of tipping material 890. The first layer of tipping material 208 preferably is adhered to the underlying plug wrap 206, and also possesses a lap or seam region 630 where a portion of the bottom or inner face of that inner tipping material 208 overlies a portion of its upper or outer face. A line of perforations 900, extending along the longitudinal length of the filter element, extends across that tipping material, and as such, defines a type of demarcation between the inner and outer tipping materials 208, 250. The tipping material extends around the cigarette to provide the second layer of tipping material 250. The second layer of tipping material 250 preferably possesses a lap or seam region 920 where a portion of the bottom or inner face of that outer tipping material 250 overlies a portion of its upper or outer face and can be adhered thereto. That lap zone or region 920 for the second tipping material 250 is typically less than about 4 mm, often less than about 3 mm, and is frequently about 1.5 mm to about 2.5 mm in width. In addition, beyond the seam region 920, the second or outer tipping material 250 possesses an extended region 680, which preferably does not have adhesive applied to its inner face, but rather, lies over its underlying outer surface and is sufficiently free to act as a tab that can be grasped by the fingers of the user. The extended region, which preferably extends along a portion of the length of the cigarette, and for the entire length of the second tipping material, has a width that can vary. For example, the extended region often can have a width of about 1 mm to about 5 mm, and often about 2 mm to about 4 mm.

Figure 11:
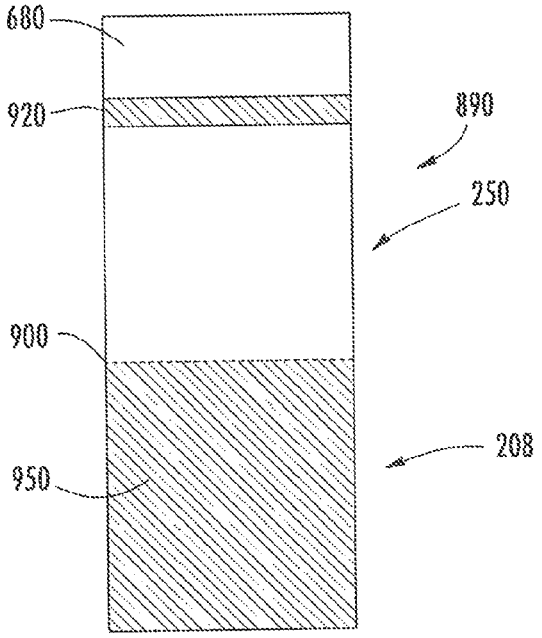
FIG. 11 is a view of tipping material useful for the manufacture of a cigarette of the generally type set forth in FIG. 10.

Referring to FIG. 11, there is shown a single piece of "patch" of tipping material 890 that can be used to form the double wrapped tipping material shown in FIG. 10. The representative single piece is at least roughly twice the length of a conventional piece or "patch" of tipping material. Thus, the tipping material piece 890 can form an inner layer 208 and an outer layer 250 when that tipping material is wrapped twice around the relevant regions of cigarette components. The inner face of the inner region 208 can have adhesive 950 applied thereto, in order to adhere that portion of the tipping material 890 to relevant regions of cigarette components. The line of perforations 900 allows the tipping material 890 to be separated into two pieces. A line of adhesive can be placed in the lap or seam region 920 (e.g., which can be applied by "skip gap" techniques) provides for fastening, securing, or connecting the outer layer of tipping material 250 in place. The optional tab region 680 extends beyond the adhesive line of the lap region 920.

For various embodiments of the present invention, depending upon the selection of the tipping materials, the first (i.e., inner) tipping material and the second (i.e., outer) tipping material can be different from one another (e.g., in terms of visual appearance, composition, physical properties or characteristics such as basis weight, sizing level, inherent porosity, opacity, sensory characteristics, and/or general dimensions). Alternatively, those inner and outer tipping materials can be substantially identical to one another.

In one embodiment, the first tipping material can be one color or of one type of appearance (e.g., white in appearance), and the second tipping material, which preferably can be removable from the cigarette, can be another color or of another type of appearance (e.g., printed so as to have a brown cork-type of appearance or printed with other indicia). Other cosmetic differences can be provided by using one type of tipping material that is smooth, high opacity, shiny, or of high luster in appearance, and one type of tipping material that is rough, low opacity, dull or satiny in appearance. Other visual effects can be provided by using different graphics on each of the two tipping materials. Thus, there is provided a manner or method by which the smoker can, by removing the second tipping material from the cigarette during use, select the desired general appearance or of a cigarette.

In one embodiment, the first tipping material can be selected so as to possess one type of tactile character, and the second tipping material, which preferably can be removable from the cigarette, can possess a difference type of tactile character. For example, the inner tipping material can possess an outer surface that can be characterized as wavy, rough, variegated, possessing folds or creases, having an accordion-type or bellows-type configuration, or the like; while the outer tipping material can possess an outer surface that can be characterized as smooth, slick, or the like. In that regard, suitable coating agents (e.g., a lacquer) that provide a slick, smooth feel to the outer surface of the outer tipping material can be employed. Alternatively, the inner tipping material can be highly perforated (e.g., from the bottom face outwards), embossed, subjected to fillagraining processing, printed with coatings (e.g., ink formulations or starch-based materials that provide raised or textured surface properties), or treated with particulate material within an adhesive film). For example, sugar crystals, salt crystals, rupturable flavor-containing microcapsules, cellulosic fibers, particles of calcium carbonate, or the like, can be secured to the outer surface of the inner tipping material using an over-layer or patterned over-layer of a suitable adhesive.

Tipping materials that each can provide a mouth end region that can exhibit a different feeling when placed in the lips of the smoker also can be accomplished through the use of two types of laminated tipping materials. For example, the inner face of the outer tipping material can be coated with a suitable release coating; and the outer face of the inner tipping material can treated so as to have regions that provide for desired adhesion to the release coating as well as regions that provide the desired surface texture. Thus, there is provided a manner or method by which the smoker can, by removing the second tipping material from the cigarette during use, select the tactile sensation provided by the outer mouth end region of that cigarette.

In one embodiment, the first tipping material can be selected so as to possess certain other physical properties, and the second tipping, which preferably can be removable form the cigarette, can possess different physical properties. For example, the tipping materials can differ is terms of basis weight, thickness, tensile strength, wet strength, moisture porosity, air permeability, flexibility, general or overall hardness, general or overall softness, or the like.

In one embodiment, the first tipping material can be selected so as to possess the ability to secure the filter element to the tobacco rod. Such can be provided by selection of a material having desired surface properties, ability to seal, ability to accept adhesive, and the like. The second tipping material can be selected so as to provide desirable visual, tactile and sensory properties. As such, cigarettes of both highly desirable sensory quality and good physical integrity can be provided.

In one embodiment, the first tipping material can be selected so as to exhibit one type of aroma or flavor sensation, and the second tipping material, which can be removable from the cigarette, can be selected so as to exhibit another type of aroma or flavor sensation. In one aspect, the amount of aromatic or flavoring agent carried by one of the tipping materials can differ from that amount carried by the other. Thus, for example, an outer tipping material carrying a relatively low level of aromatic or flavoring agent can provide one type of sensation; while an inner tipping material carrying a relatively high level of aromatic or flavoring agent can, when the outer tipping material is removed from the cigarette, provide impact in terms of the delivery of that aromatic or flavoring agent to the lips and mouth of the smoker. In certain embodiments, the outer tipping material can be adapted to prevent flavorants incorporated in between the tipping materials or within the inner tipping material from escaping prior to use of the cigarette, or can be adapted to mask the flavorant prior to cigarette use. At the time of use, the smoker can remove the outer wrapping material to expose the flavorant.

Exemplary manners and methods for providing encapsulated materials, such as microencapsulated flavoring agents, are set forth in Gutcho, Microcapsules and Microencapsulation Techniques (1976) and Gutcho, Microcapsules and Other Capsules Advances Since 1975 (1979). Exemplary types of microcapsules can have diameters of less than 100 microns, an often can have outer shells that are gelatin based, cyclodextrin based, or the like. Microcapsules have been commercially available, and exemplary types of microcapsule technologies are of that type set forth in Kondo, Microcapsule Processing and Technology (1979); Iwamoto et al., AAPS Pharm. Sci. Tech. 2002 3(3): article 25; and U.S. Pat. Nos. 3,550,598 to McGlumphy and 6,117,455 to Takada et al.

In one embodiment, releasable flavoring or aromatic agents, such as are provided by encapsulated flavor materials, can be incorporated into either or both of the first and second tipping materials. For example, microcapsules can be positioned in the region between the layers of tipping materials; and such flavors can be released by application of pressure or peeling of the outer tipping material from the inner tipping material.

Exemplary flavoring agents suitable for use in the invention may be natural or synthetic, and the character of these flavors can be described, without limitation, as fresh, sweet, herbal, confectionary, floral, fruity or spice. Specific types of flavors include, but are not limited to, vanilla, coffee, chocolate, cream, mint, spearmint, menthol, peppermint, wintergreen, lavender, cardamon, nutmeg, cinnamon, clove, cascarilla, sandalwood, honey, jasmine, ginger, anise, sage, licorice, lemon, orange, apple, peach, lime, cherry, and strawberry. See also, Leffingwill et al., Tobacco Flavoring for Smoking Products, R. J. Reynolds Tobacco Company (1972). Flavorings also can include components that are considered moistening, cooling or smoothening agents, such as eucalyptus. These flavors may be provided neat (i.e., alone) or in a composite (e.g., spearmint and menthol, or orange and cinnamon). Composite flavors may be combined in a single capsule as a mixture, or as components of multiple capsules.

In one embodiment, the tipping materials can include printed indicia for marketing or other purposes. For example, markings or indicia on either or both of the tipping materials can aid in identification of properly manufactured cigarettes so as to assist in identifying or recognizing counterfeit cigarettes. As another example, markings on the inner or outer face of a removable outer tipping material can be used to identify product, act as a coupon or ticket, act a game piece, or the like.

In one embodiment, the tipping materials can be used to enhance the degradability of spent cigarette portions, such as cigarette butts. For example, outer tipping materials, which might be desirable for providing certain sensory characteristics, can be removed after the cigarette is smoked. That portion of the outer tipping material removed from the cigarette butt can be disposed of separately from the remainder of the cigarette butt. As such, absence of that tipping material within the cigarette butt can provide for enhanced degradability of the remaining butt components.

In certain embodiments, the outer tipping material can be constructed of a paper having characteristics and qualities, such as combustibility, commonly associated with cigarette paper used as smokable rod wrapping material 190. In such embodiments, the outer tipping material is designed to be removed from the inner tipping material though use of, for example, a pressure sensitive adhesive or skip gap adhesive application between the inner and outer tipping material that provides sufficient adhesive strength to maintain the outer tipping material in place prior to use by the smoker, but which can be removed from the inner tipping material when desired. As such, the outer tipping material can be removed to expose the inner tipping material prior to smoking. Alternatively, the user may, in certain embodiments, slide the outer tipping material down to the smokable rod portion of the cigarette such that a portion of the smokable rod has a double layer of wrapping material. The presence of the double wrapping on a portion of the smokable rod can reduce visible sidestream smoke or alter the sensory characteristics (e.g., the flavor or aroma characteristics of the smoke) or chemistry of the smoke generated by the cigarette. For example, the outer tipping material may include any of the flavoring or aroma agents discussed herein, including, for example, the flavor and aroma precursors discussed in U.S. Pat. No. 4,941,486 to Dube et al., which is incorporated by reference herein. In this manner, the smoker can selectively alter the sensory characteristics of the smoke as desired or simply remove the outer tipping material.

Many modifications and other embodiments of the invention will come to mind to one skilled in the art to which this invention pertains having the benefit of the teachings presented in the foregoing description; and it will be apparent to those skilled in the art that variations and modifications of the present invention can be made without departing from the scope or spirit of the invention. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method of manufacturing a filtered cigarette comprising a smokable rod and a filter element having a mouth end terminus, the method comprising:

a) providing a cigarette rod comprising a smokable rod portion and a filter element portion, wherein the filter element portion includes an overlying plug wrap;

b) applying a first tipping material to the filter element portion of the cigarette rod, the first tipping material overlying the plug wrap; and c) applying a second tipping material to the filter element portion of the cigarette rod, the second tipping material overlying the first tipping material, the second tipping material comprising a perforated region adapted to facilitate removal of at least a portion of the second tipping material and a tab region adapted for grasping for removal of at least a portion of the second tipping material, wherein the perforated region extends along a longitudinal length of the filter element and extends across the second tipping material such that at least a portion of the second tipping material extending from the tab region to the perforated region is removable.

2. The method of claim 1, wherein the cigarette rod is a two-up cigarette rod.

3. The method of claim 1, wherein the applying steps b) and c) comprise applying a preformed tipping material laminate comprising two layers of tipping material in order to form both the first tipping material and the second tipping material.

4. The method of claim 3, wherein the tipping material laminate comprises a first layer of tipping material having a first edge and a second edge and a second layer of tipping material, wherein the first layer and the second layer are offset such that, when wrapped around the cigarette rod, the first edge of the first layer of tipping material can overlie the second edge of the first layer of tipping material.

5. The method of claim 1, wherein the applying steps b) and c) comprise wrapping a single piece of tipping material around the filter element portion of the cigarette rod in order to form both the first tipping material and the second tipping material.

6. The method of claim 1, further comprising applying a release coating to an inner surface of the second tipping material or to an outer surface of the first tipping material to facilitate removal of the second tipping material.

7. The method of claim 6, wherein the release coating comprises a pressure-sensitive adhesive.

8. The method of claim 1, further comprising the step of applying an adhesive to a first location on an inner surface of the second tipping material so as to provide for a longitudinally extending strip to tack the second tipping material to the first tipping material, and applying adhesive to a second location in order to provide a longitudinally extending strip to tack the second tipping material onto itself.

9. The method of claim 1, further comprising applying a series of air dilution perforations through one or both of the first and second tipping materials.

10. The method of claim 1, further comprising incorporating a flavorant between the first and second tipping materials or within the first tipping material such that removal of the second tipping material exposes the flavorant.

11. The method of claim 10, wherein the flavorant is in the form of rupturable flavor-containing microcapsules.

12. The method of claim 11, wherein rupturable flavor-containing microcapsules are secured to an outer surface of the first tipping material.

13. The method of claim 11, wherein the microcapsules comprise multiple flavorants, the multiple flavorants being present in separate microcapsules or mixed together in the same microcapsules.

14. The method of claim 11, wherein the microcapsules comprise a cooling agent.

15. The method of claim 10, wherein the flavorant is selected from the group consisting of vanilla, coffee, chocolate, cream, mint, spearmint, menthol, peppermint, wintergreen, lavender, cardamon, nutmeg, cinnamon, clove, cascarilla, sandalwood, honey, jasmine, ginger, anise, sage, licorice, lemon, orange, apple, peach, lime, cherry, strawberry, and combinations thereof.

16. The method of claim 10, wherein the flavorant is a cooling agent.

17. The method of claim 1, wherein the first tipping material exhibits a first aroma or flavor sensation, and the second tipping material exhibits a second aroma or flavor sensation different from the first aroma or flavor sensation.

18. The method of claim 1, wherein the first and second tipping materials are substantially identical in overall dimension.

19. The method of claim 1, wherein an inner surface of the first tipping material is fixedly secured to an outer surface of the plug wrap.

20. The method of claim 1, wherein the visual appearance of the second tipping material differs from that of the first tipping material.

21. The method of claim 1, wherein the tactile characteristics of the second tipping material differ from those of the first tipping material.

22. The method of claim 21, wherein the first tipping material has a rough outer surface and the second tipping material has a smooth outer surface.

23. The method of claim 22, wherein the rough outer surface of the first tipping material is attributable to perforations, embossing, or a textured coating.

24. The method of claim 1, wherein the second tipping material comprises printed indicia on its inner face.

25. The method of claim 1, wherein the second tipping material extends further along the longitudinal periphery of the smokable rod than the first tipping material.

26. The method of claim 1, wherein the first tipping material extends further along the longitudinal periphery of the smokable rod than the second tipping material.

* * * * *